US011253750B1

(12) United States Patent
Solomon et al.

(10) Patent No.: US 11,253,750 B1
(45) Date of Patent: Feb. 22, 2022

(54) MONOFIN SWIMMING DEVICE

(71) Applicant: Blue Springs Partners, LLC, Idaho Falls, ID (US)

(72) Inventors: Peter Solomon, Fort Lauderdale, FL (US); Steven Browning, Rigby, ID (US)

(73) Assignee: Blue Springs Partners, LLC, Idaho Falls, ID (US)

( * ) Notice: Subject to any disclaimer, the term of this patent is extended or adjusted under 35 U.S.C. 154(b) by 0 days.

(21) Appl. No.: 17/001,080

(22) Filed: Aug. 24, 2020

(51) Int. Cl.
*A63B 31/11* (2006.01)

(52) U.S. Cl.
CPC ..... *A63B 31/11* (2013.01); *A63B 2031/117* (2013.01); *A63B 2244/20* (2013.01)

(58) Field of Classification Search
CPC ..... A63B 31/11; A63B 2244/20; A63B 2031/117
See application file for complete search history.

(56) References Cited

U.S. PATENT DOCUMENTS

2015/0343268 A1* 12/2015 Wiseman ..... A63B 31/11 441/64
2020/0282265 A1* 9/2020 Lam ..... A63B 31/11

* cited by examiner

*Primary Examiner* — Andrew Polay
(74) *Attorney, Agent, or Firm* — Park, Vaughan, Fleming & Dowler LLP

(57) ABSTRACT

A monofin swimming device comprising a skeleton and an outer shell, wherein the combination attaches to a user's feet to assist in propelling the user through the water.

10 Claims, 16 Drawing Sheets

MONOFIN SWIMMING DEVICE

TECHNICAL FIELD

The presently disclosed and claimed inventive concepts generally relate to an apparatus for swimming and, more particularly, to a monofin swimming device.

BACKGROUND

Swimming is a popular activity among millions of people every year. It is not uncommon to see a swimmer keep their feet together and swim in a style similar to a mermaid or a dolphin. This provides a different exercise as well as additional enjoyment for the swimmer.

In order to improve the ability of a swimmer to mimic a mermaid while swimming, several monofins have been developed that increase the propulsion force of a user's feet while swimming in the mermaid style. A monofin keeps both of a user's feet connected to a single fin while having a large flat surface extending away from the user's feet.

Several limits to existing monofins have been noted. One is related to the propulsion force afforded by the monofin. The propulsion force of a monofin is limited if the monofin is too limber (i.e., not sufficiently rigid) since the amount of water it displaces on any given stroke is reduced by deformation in the fin caused by the force of the water sought to be displaced. Contrarily, an unduly rigid monofin affords more propulsion due to its diminished deformation on any given stroke, but it can, consequently, require too much effort or strength to use comfortably.

Likewise, the size of a monofin can affect its propulsion force. A large monofin generally will impart more propulsion force than a smaller monofin of the same characteristics. There are, however, practical and utilitarian limitations on the size of a monofin. For example, while "bigger might be better" for some swimming activities, transportability of the monofin also is important to users. Accordingly, a need has arisen for a new monofin that provides increased propulsion while not being unduly difficult to use and/or transport.

SUMMARY

Disclosed is a swimming device in the shape of a monofin that allows a user's feet to function similar to a mermaid or dolphin tail. The swimming device may include a skeleton and outer shell, where the skeleton may include one or more ribs, open areas, rigid material, and/or foot pads.

DETAILED DESCRIPTION OF THE EXEMPLARY EMBODIMENTS

The invention will be illustrated in more detail with reference to the following embodiments, but it should be understood that the present invention is not deemed to be limited thereto.

Figure 1:
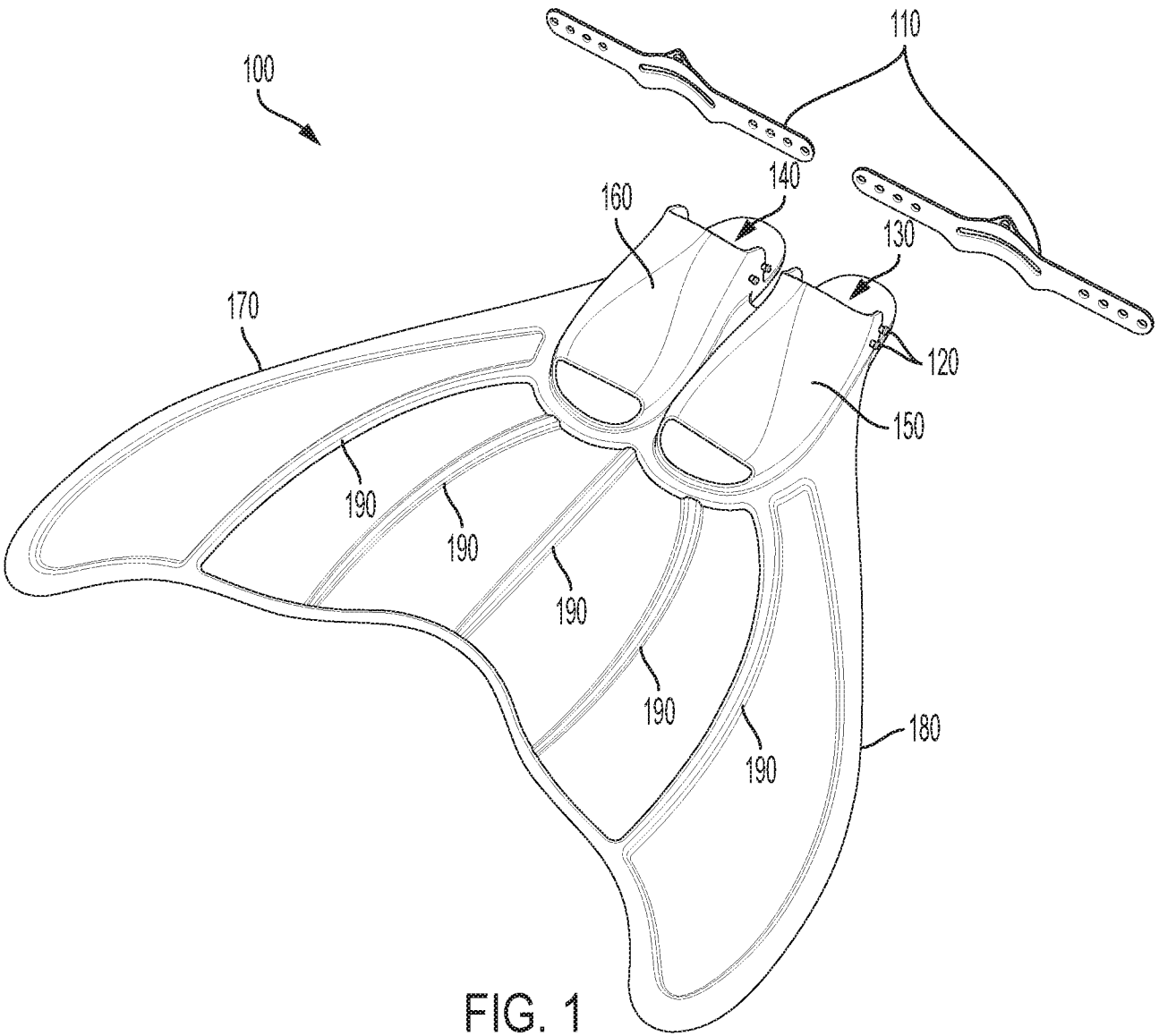
FIG. 1 is a top perspective view of a monofin with detached foot straps in accordance with an embodiment of the inventive concepts.

Referring now to the drawings, wherein like part numbers refer to like elements throughout the several views, there is shown in FIG. 1 a top perspective view of an exemplary monofin or swimming device 100 shaped in accordance with a mermaid or dolphin tail. Swimming device 100 has associated with it removable or detachable foot straps 110. One such foot strap 110 is shown in more detail in FIG. 16. It should be recognized (as with all Figures and embodiments specifically described herein) that FIG. 1 is merely illustrative of the present invention, such that in this instance integrated, non-detachable foot straps also are within the spirit and scope of the present invention. FIG. 1 also shows swimming device 100 as including tabs 120 as exemplary attachment devices for attaching detachable foot straps 110 to the swimming device. Also shown is left foot insert 130 and right foot insert 140, into which a user inserts her left and right foot, respectively, when donning the swimming device. The swimming device also includes left foot cover 150 and right foot cover 160. While the foot covers 150 and 160 are shown as partially covering a user's foot (i.e., the toe and heel ends are open), it should be understood that other embodiments are within the scope and spirit of the present invention. Namely, in this instance, foot covers 150 and 160 could entirely cover a user's foot, such that no toe and/or heel opening exists on the swimming device. Finally, FIG. 1 illustrates this particular embodiment of swimming device 100 as including right edge 170, left edge 180, and one or more rib 190. Notably, right edge 170 and left edge 180 can also be considered a rib 190.

Figure 2:
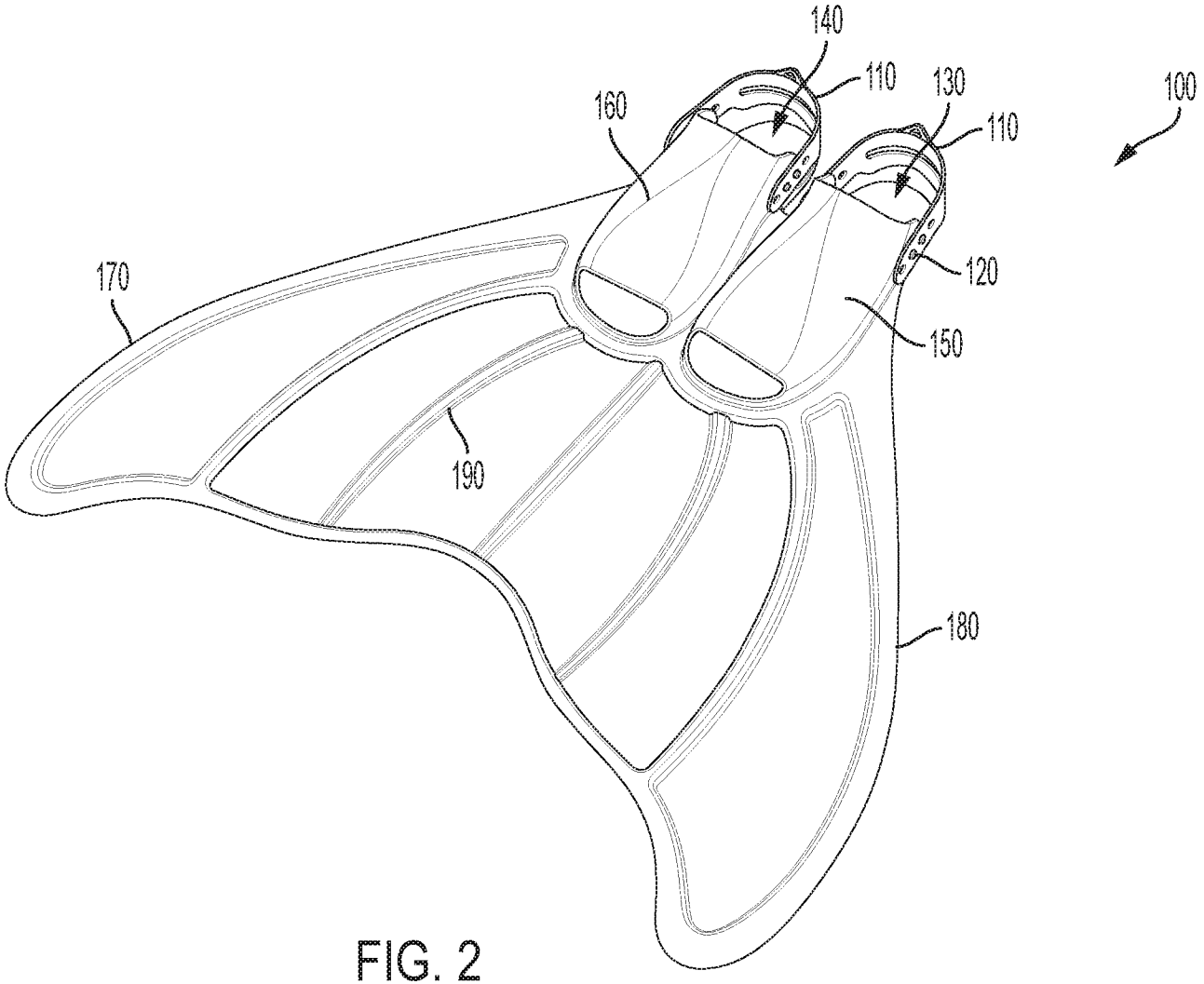
FIG. 2 is a top perspective view of a monofin with attached foot straps in accordance with an embodiment of the inventive concepts.

FIG. 2 is a top perspective view of an exemplary monofin or swimming device 100 like FIG. 1, except FIG. 2 illustrates an embodiment in which foot straps 110 are attached to the swimming device. Specifically, FIG. 2 illustrates an embodiment in which there are two separate foot straps 110, wherein each separate foot strap attaches, via one or more tabs 120, to the swimming device. As indicated above, the size, shape, and attachment mechanism are illustrative only; other embodiments for maintaining a user's foot within the swimming device will be recognized by those skilled in the art, and such embodiments are expressly incorporated into the scope and spirit of the present invention. As an example only, and as mentioned above, non-detachable foot straps are envisioned and constitute an embodiment within the scope of the present invention.

Figure 3:
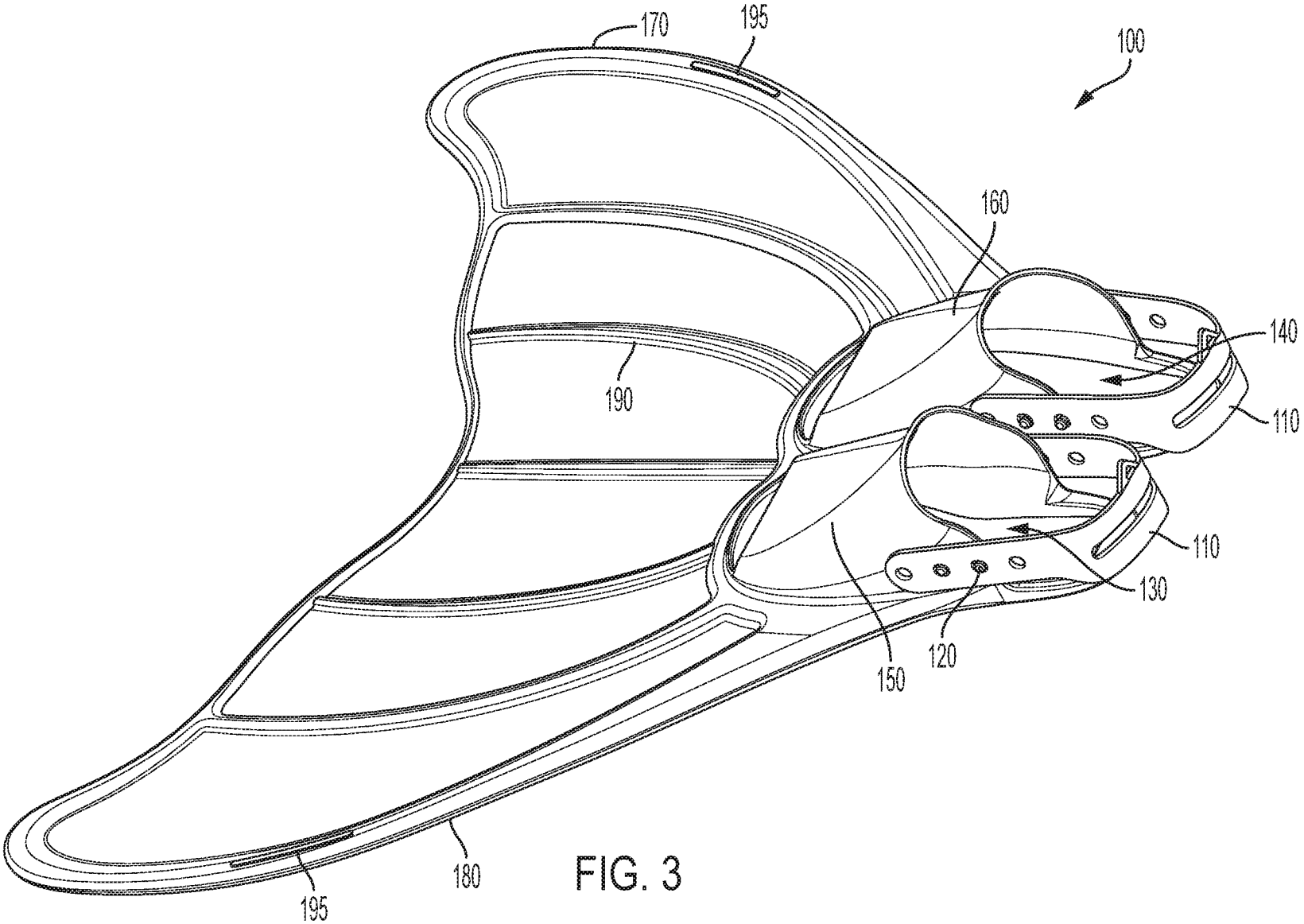
FIG. 3 is another top perspective view of a monofin with attached foot straps in accordance with an embodiment of the inventive concepts.

FIG. 3 is a top perspective view of an exemplary monofin or swimming device 100 like FIGS. 1 and 2, except FIG. 3 illustrates an embodiment including fastening device or tab 195. As shown, a fastening tab 195 exits on right edge 170 and on left edge 180. As will be described in more detail below in connection at least with FIGS. 7-11, fastening tab 195 assists in maintaining together various separate components of the swimming device. It should be noted that while FIG. 3 illustrates an embodiment including two fastening tabs 195, other embodiments can have none, one, or more than the two illustrated. Likewise, the fastening tabs are not limited to being disposed on right edge 170 and/or left edge 180. They can be disposed in any location that assists in maintaining together the various separate components of the swimming device.

Figure 5:
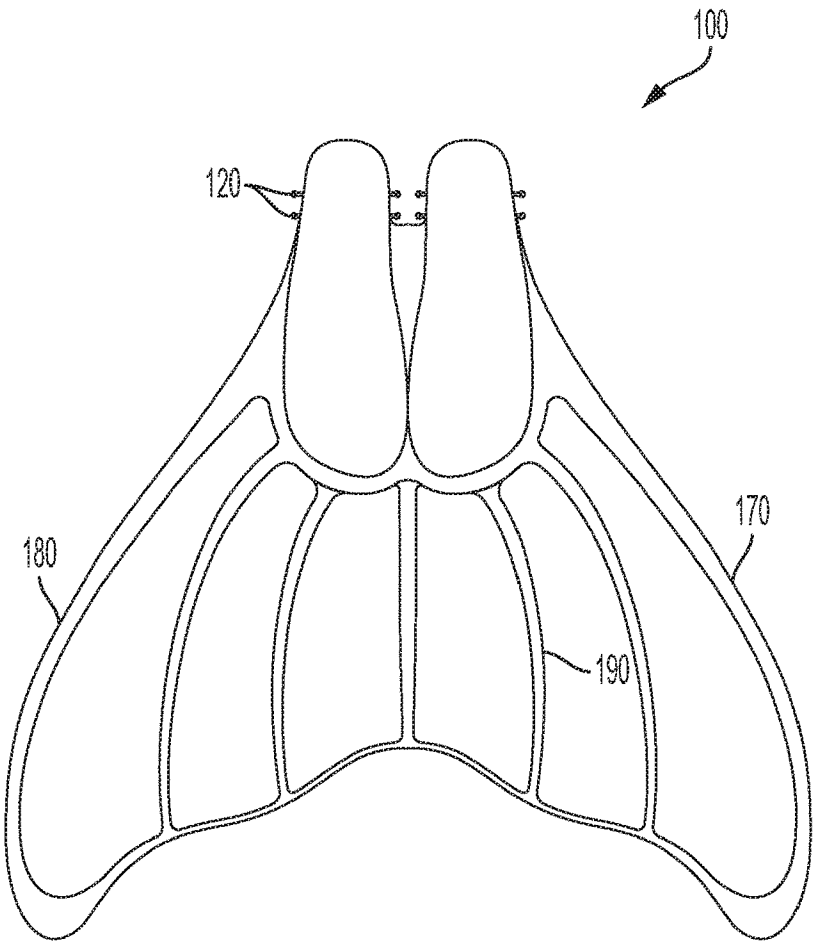
FIG. 5 is a bottom view of a monofin without foot straps in accordance with an embodiment of the inventive concepts.
Figure 4:
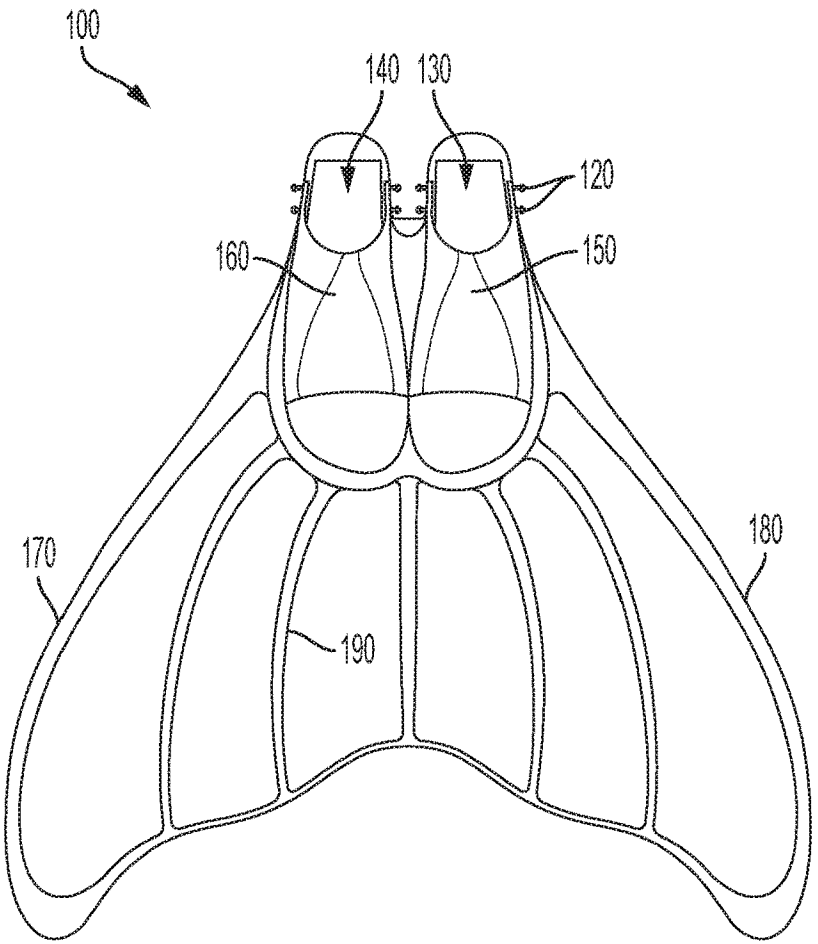
FIG. 4 is a top view of a monofin without foot straps in accordance with an embodiment of the inventive concepts.
Figure 6:
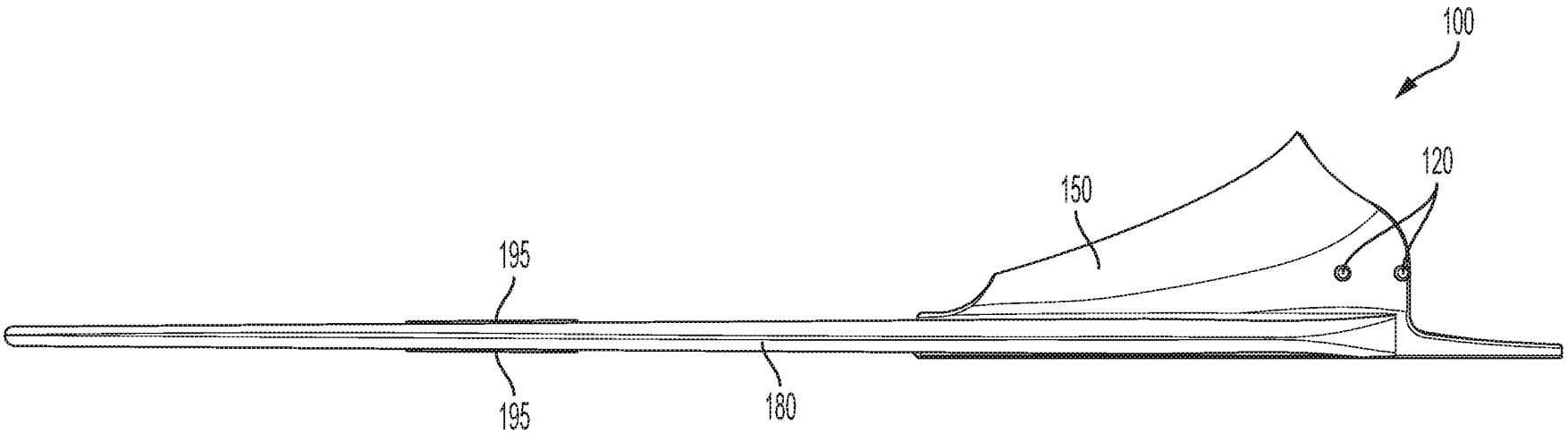
FIG. 6 is a left side view of a monofin without foot straps in accordance with an embodiment of the inventive concepts.

FIG. 4 is a top view of an exemplary embodiment of swimming device 100, and FIG. 5 is a bottom view of an exemplary embodiment of swimming device 100. FIG. 6 is a left side view of an exemplary embodiment of swimming device 100. An exemplary embodiment of fastening tab 195 also is shown in FIG. 6. Specifically, in this particular embodiment, fastening tab 195 exists on both the top and bottom of left edge 180. While a right side view of swimming device 100 is not included, it is contemplated that right edge 170 would likewise include a fastening tab 195, just like fastening tab 195 on left edge 180. That said, it should be appreciated, as indicated above, that while FIG. 6 illustrates an embodiment contemplating two fastening tabs 195, other embodiments can have none, one, or more than two. Likewise, the fastening tabs are not limited to being disposed on right edge 170 and/or left edge 180. They can be disposed (to the extent they are used) in any location that assists in maintaining together the various separate components of the swimming device.

Figure 7:
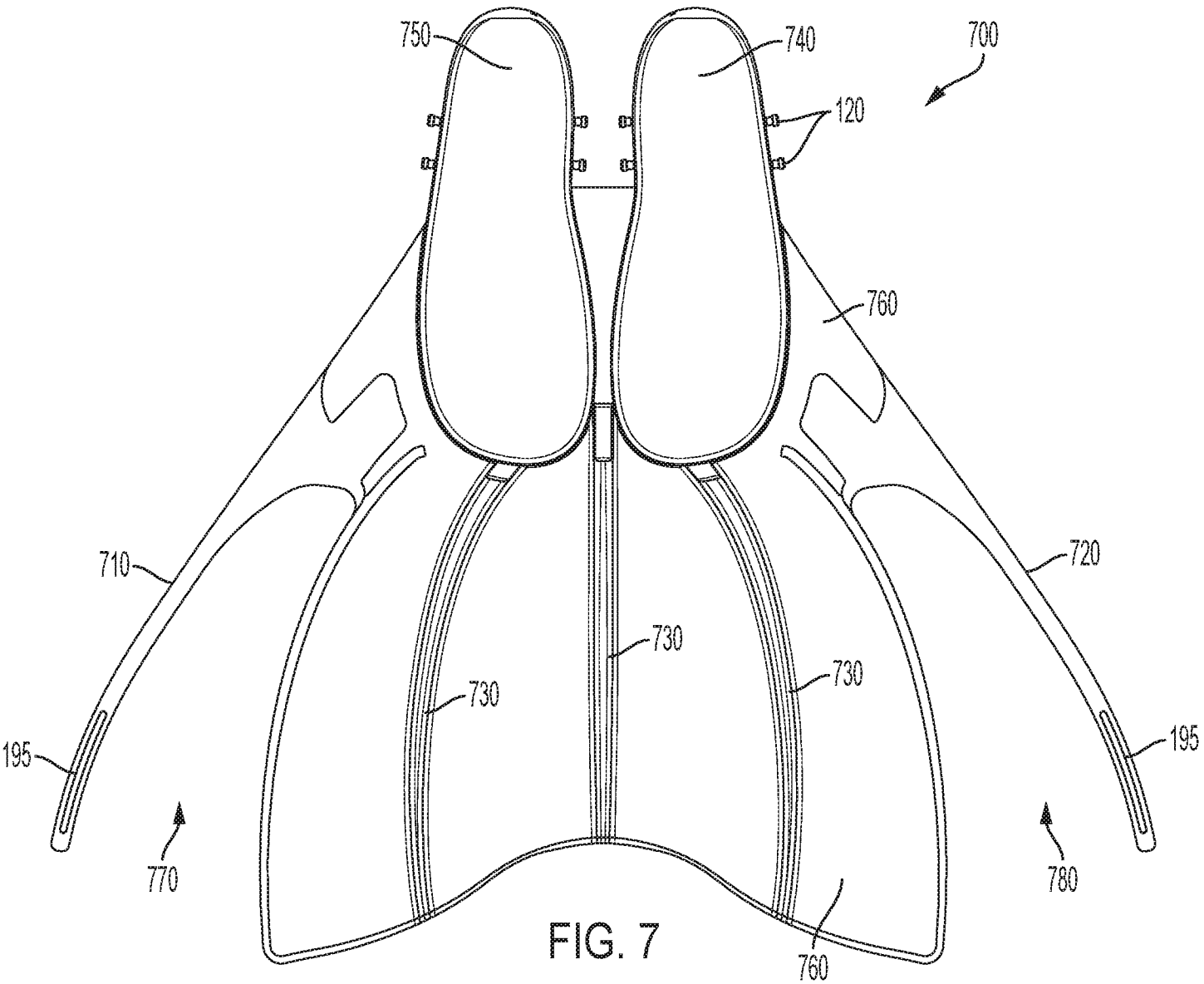
FIG. 7 is a top view of a skeleton for a monofin in accordance with an embodiment of the inventive concepts.

FIG. 7 is a top view of an exemplary skeleton 700 for the monofin or swimming device 100 of FIGS. 1-6. Skeleton 700 is comprised of a rigid material intended to add strength and rigidity as a core to swimming device 100.

FIG. 7 shows skeleton 700 including tabs 120 as exemplary attachment devices for attaching detachable foot straps 110 to the skeleton. FIG. 7 also illustrates this particular embodiment of skeleton 700 as including right rib 710, left rib 720, and one or more intervening ribs 730. The shape and relative location of each rib can differ from that shown in FIG. 7 and still be within the spirit and scope of the present invention. Rigid material 760 spans the gap between one or more of ribs 710, 720, and/or 730. Likewise, open areas 770 and 780 exist between one or more of ribs 710, 720, and/or 730. Also shown in FIG. 7 is left foot bottom 740 and right foot bottom 750, which support the bottom of a user's left and right foot, respectively. Left foot bottom 740 and right foot bottom 750 are depicted as having an flat surface, but they also could have an undulating surface intended to better conform to a user's foot.

As described in more detail in connection with FIGS. 17-23, as an additional embodiment, one or more intervening ribs 730 may include a flexible material and/or a folding mechanism, such as a hinge, to enable the monofin to fold or bend along that rib. This allows a user to fold or deform the monofin into a smaller size when transporting the monofin. Indeed, it is contemplated that the placement of the one or more folding ribs 730 could be positioned on the monofin such that, when folded, would enable the monofin to fit into a standard size suitcase or swim bag. Other locations of the one or more folding ribs are contemplated and are within the spirit and scope of the present invention.

FIG. 7 also shows fastening tab 195 from FIG. 3 and FIG. 6. As indicated above, while FIG. 7 illustrates an embodiment contemplating two fastening tabs 195, other embodiments can have none, one, or more than two. Likewise, the fastening tabs are not limited to being disposed on right rib 710 and/or left rib 720. They can be disposed in any location that assists in maintaining together various separate components of the swimming device.

Figure 8:
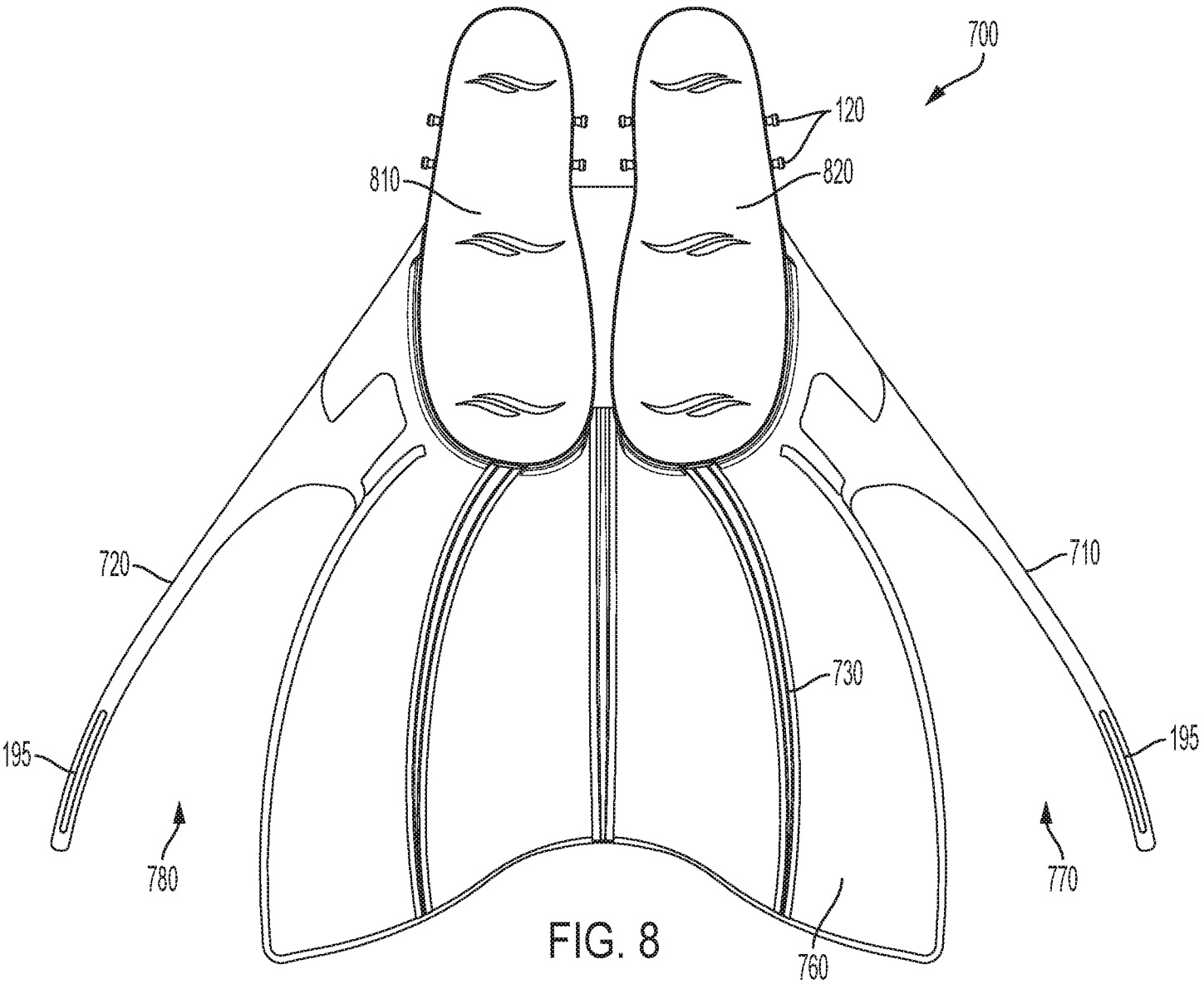
FIG. 8 is a bottom view of a skeleton for a monofin in accordance with an embodiment of the inventive concepts.

FIG. 8 is a bottom view of an exemplary skeleton 700 for the monofin or swimming device 100 of FIGS. 1-6. In addition to the features depicted by FIG. 7, FIG. 8 shows left foot pad underside 810 and right foot pad underside 820, which are depicted as having a surface contour intended to assist in maintaining together skeleton 700 with various separate components of the swimming device, analogous to that of tab 195. Optionally, the underside(s) could have a different surface contour, including a flat contour.

Figure 9:
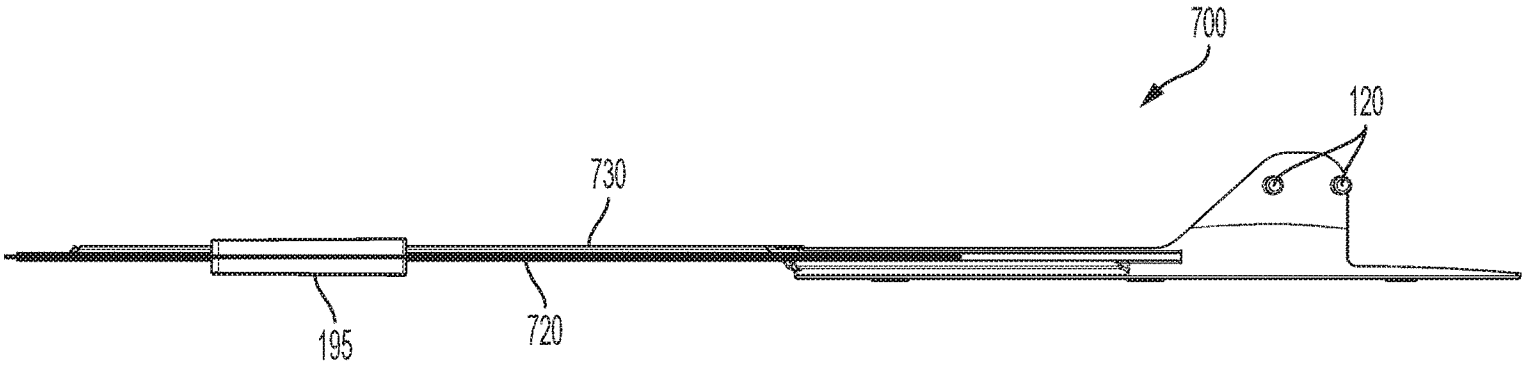
FIG. 9 is a left side view of a skeleton for a monofin in accordance with an embodiment of the inventive concepts.

FIG. 9 is a left side view of an exemplary skeleton 700 for the monofin or swimming device 100 of FIGS. 1-6. FIG. 9 shows tabs 120, left rib 720, intervening rib 730, and fastening tab 195.

Figure 10:
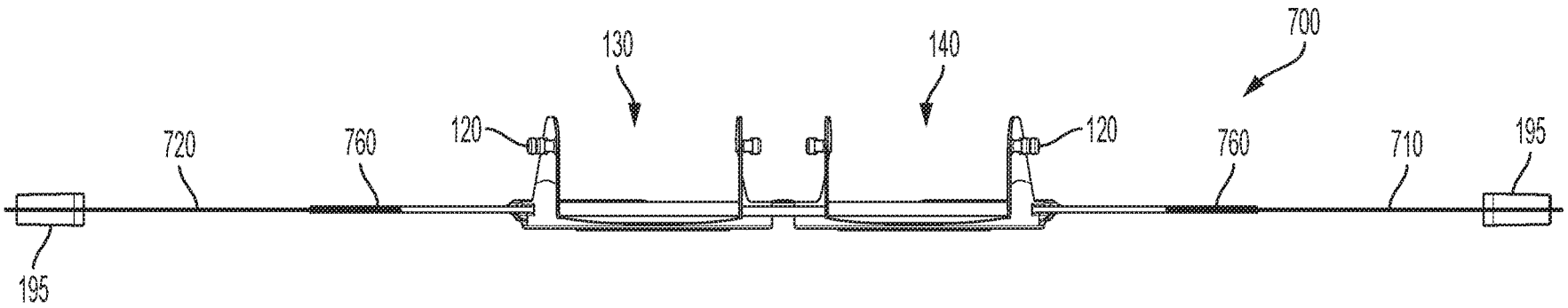
FIG. 10 is a back view of a skeleton for a monofin in accordance with an embodiment of the inventive concepts.

FIG. 10 is a back view of an exemplary skeleton 700 for the monofin or swimming device 100 of FIGS. 1-6. FIG. 10 shows tabs 120, right rib 710, left rib 720, fastening tab 195, rigid material 760, left foot insert 130, and right foot insert 140.

Figure 11:
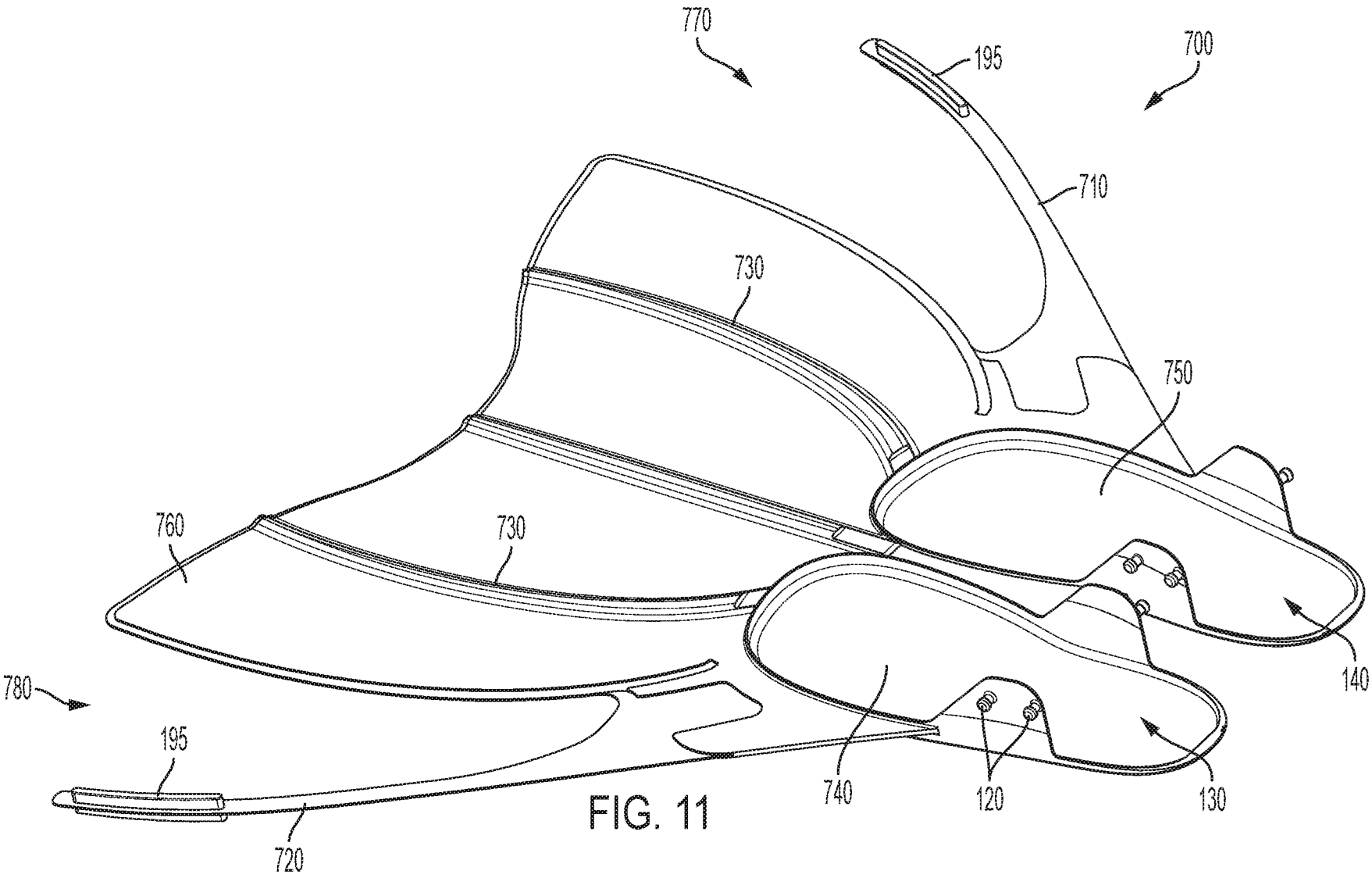
FIG. 11 is a top perspective view of a skeleton for a monofin in accordance with an embodiment of the inventive concepts.

FIG. 11 is a top perspective view of an exemplary skeleton 700 for the monofin or swimming device 100 of FIGS. 1-6. FIG. 11 shows tabs 120, left foot insert 130, right foot insert 140, right rib 710, left rib 720, intervening ribs 730, rigid material 760, open areas 770 and 780, left foot bottom 740, and right foot bottom 750. As with several of the other Figures, FIG. 11 depicts areas on skeleton 700 where the rigid surface material 760 exists and does not exist. This is intended to mean that the areas of the skeleton designated as including rigid surface material 760 are more rigid than the areas without it.

Likewise, different areas of skeleton 700 can be more or less rigid than other areas. As one skilled in the art will appreciate, depending upon how and where the areas of rigidity are placed, the monofin can be made to require more or less strength by a user to propel herself through the water and/or to bend to monofin for transport. For example, it is specifically contemplated that the thickness of right rib 710 and/or left rib 720 could be made less (thereby making the monofin slightly easier to use in the water and more easily folded for transport) or more (to impart the opposite effect). Similarly, as shown in FIGS. 7, 8, 10, and 11, the same effect could be achieved by adding another layer (see layer 760) to right rib 710 and/or left rib 720 and adjusting where on the rib the additional layer begins and ends.

Figure 12:
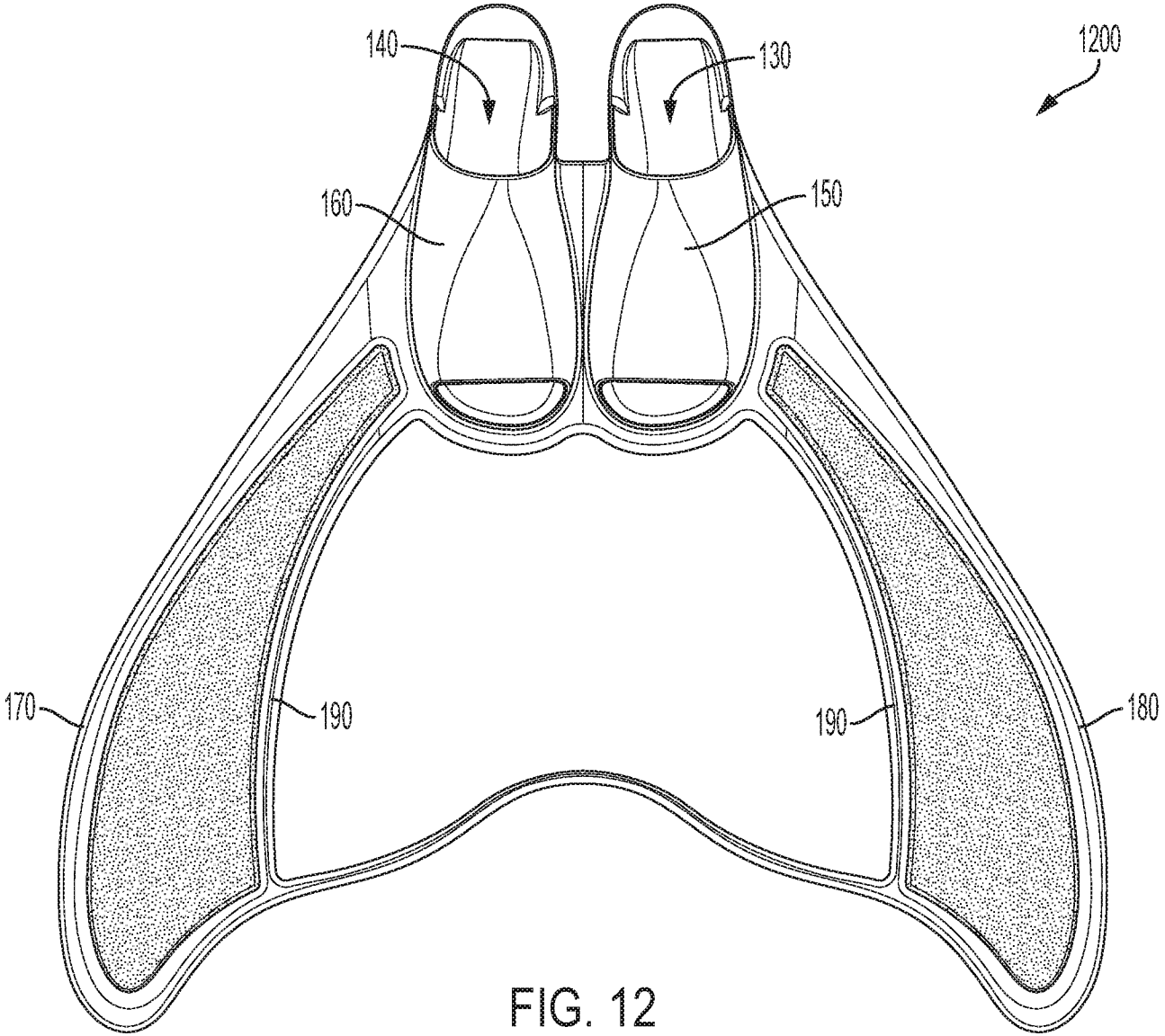
FIG. 12 is a top view of an outer shell for a monofin in accordance with an embodiment of the inventive concepts.

FIG. 12 is a top view of an exemplary outer shell 1200 of the monofin or swimming device 100 of FIGS. 1-6. Outer shell 1200 is intended to encompass (partially or wholly) skeleton 700 shown in FIGS. 7-11. Like FIG. 1, which shows a combined outer shell 1200 and skeleton 700, FIG. 12 shows left foot insert 130 and right foot insert 140, into which a user inserts her left and right foot, respectively, when donning the swimming device. Outer shell 1200 also includes left foot cover 150 and right foot cover 160. While the foot covers 150 and 160 are shown as partially covering a user's foot (i.e., the toe and heel ends are open), it should be understood that other embodiments are within the scope and spirit of the present invention. Namely, in this instance, foot covers 150 and 160 could entirely cover a user's foot, such that no toe and/or heel opening exists in the swimming device.

FIG. 12 also illustrates a particular embodiment of outer shell 1200 as including right edge 170, left edge 180, and one or more rib coverings 190. Notably, right edge 170 and left edge 180 can also be considered a rib covering 190. The number and configuration of the rib coverings 190 can be dependent on the number and configuration of ribs on skeleton 700 and/or how many of such "underlying" ribs the outer shell covers. In that regard, it should be noted that the scope of the present invention is not limited to the outer shell covering every rib or other portion of the skeleton. As an example, the shading in FIG. 12 is intended to emphasize that, in this particular embodiment, the area between rib covering 190 and ribs 170/180 includes a covering material, whereas the area between rib coverings 190 is open or devoid of material. Note also that tabs 120 are not shown in FIG. 12 since they are part of skeleton 700, not outer shell 1200. The same exists for other components of the skeleton, such as for example, fastening tabs 195.

Figure 13:
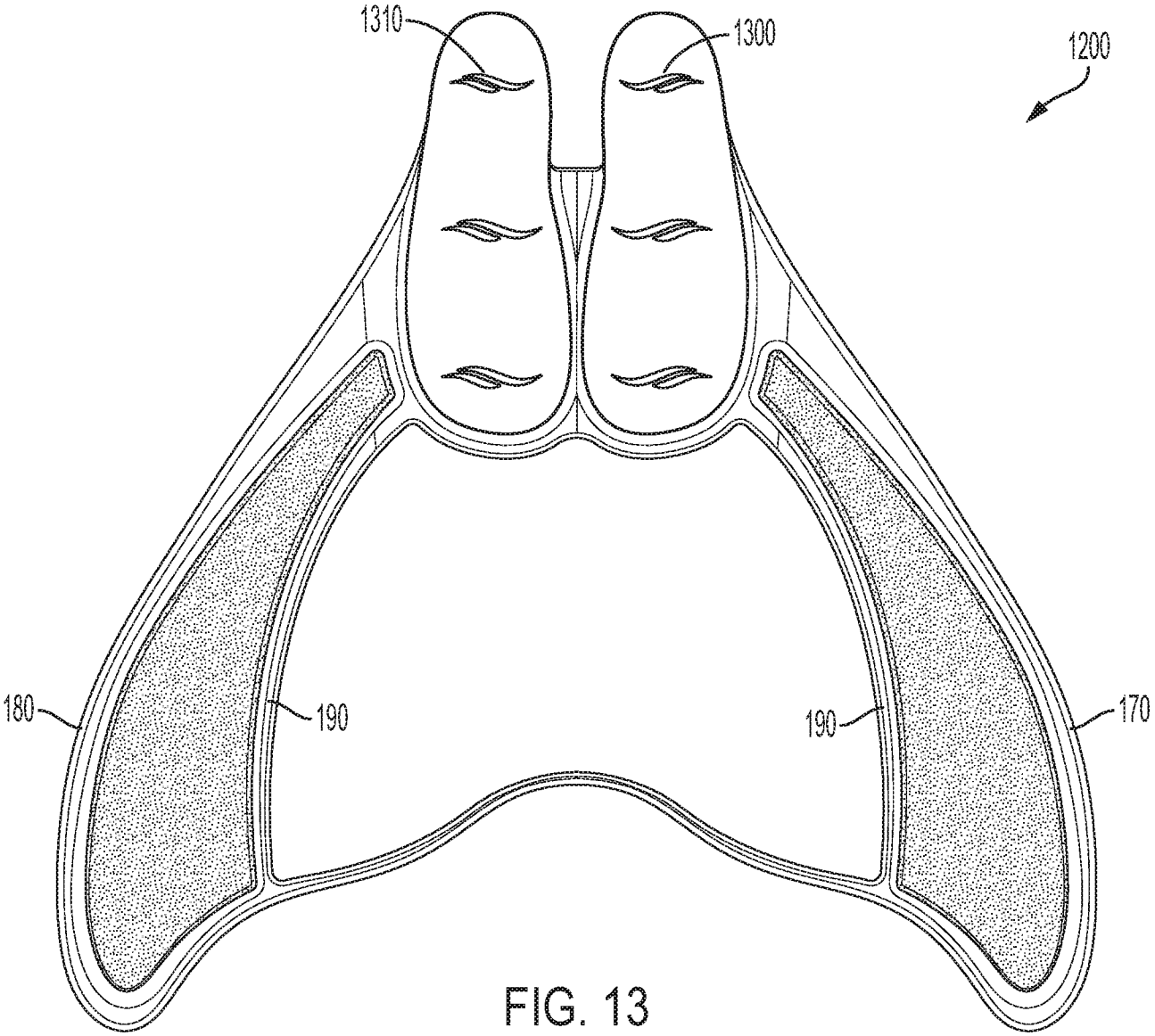
FIG. 13 is a bottom view of an outer shell for a monofin in accordance with an embodiment of the inventive concepts.

FIG. 13 is a bottom view of an exemplary outer shell 1200 of the monofin or swimming device 100 of FIGS. 1-6. FIG. 13 shows right foot bottom 1300 and left foot bottom 1310.

Figure 14:
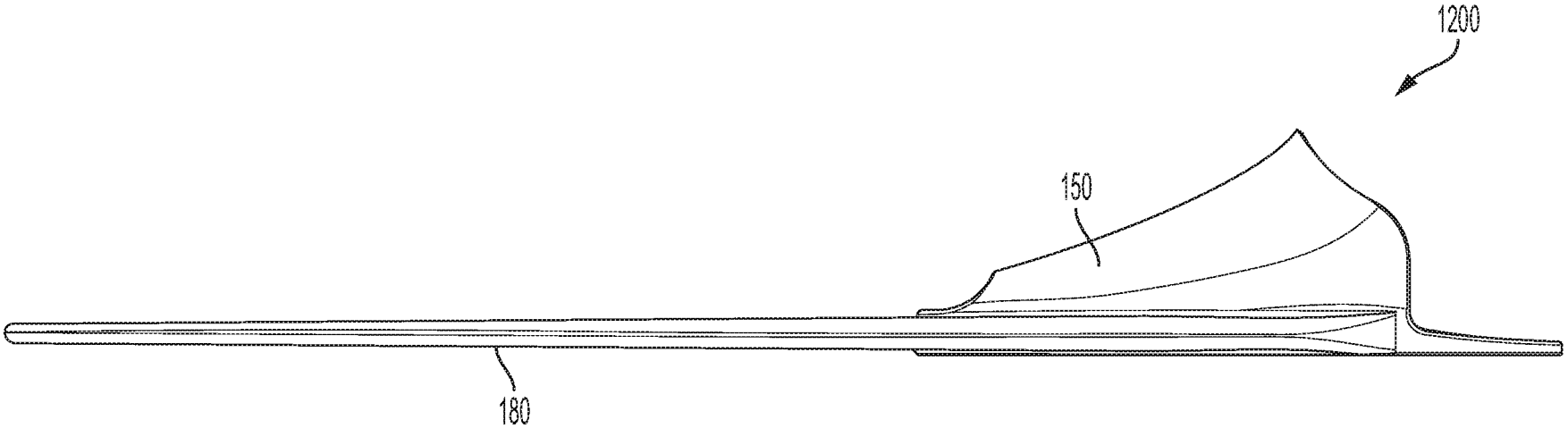
FIG. 14 is a left side view of an outer shell for a monofin in accordance with an embodiment of the inventive concepts.

FIG. 14 is a left side view of an exemplary outer shell 1200 of the monofin or swimming device 100 of FIGS. 1-6. FIG. 14 shows left edge 180 and left foot cover 150.

Figure 15:
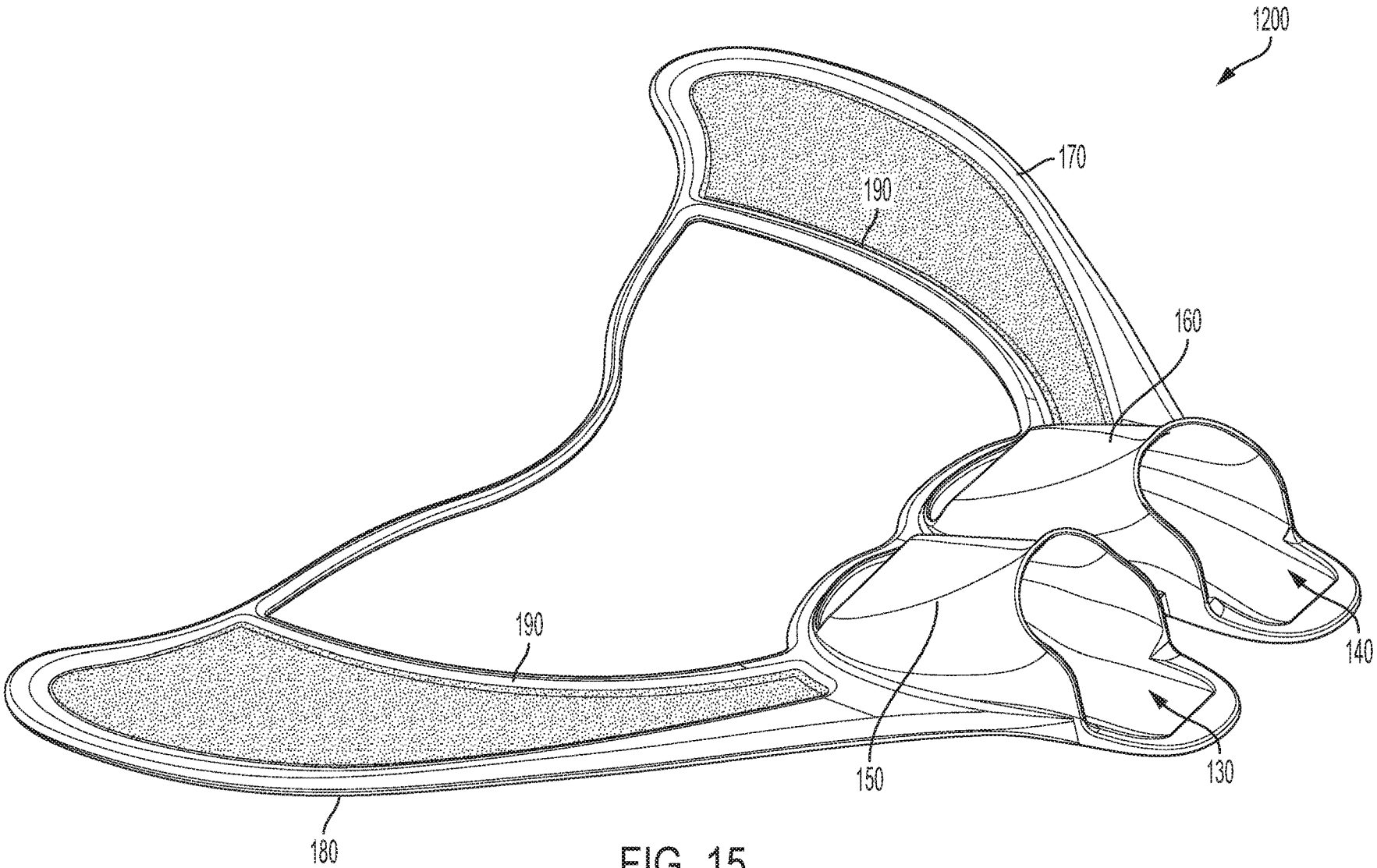
FIG. 15 is a top perspective view of an outer shell for a monofin in accordance with an embodiment of the inventive concepts.

FIG. 15, consistent with FIG. 12, is a top perspective view of exemplary outer shell 1200 of the monofin or swimming device 100 of FIGS. 1-6. FIG. 15 shows left foot insert 130, right foot insert 140, left foot cover 150, right foot cover 160, right edge 170, left edge 180, and one or more rib coverings 190.

Figure 16:
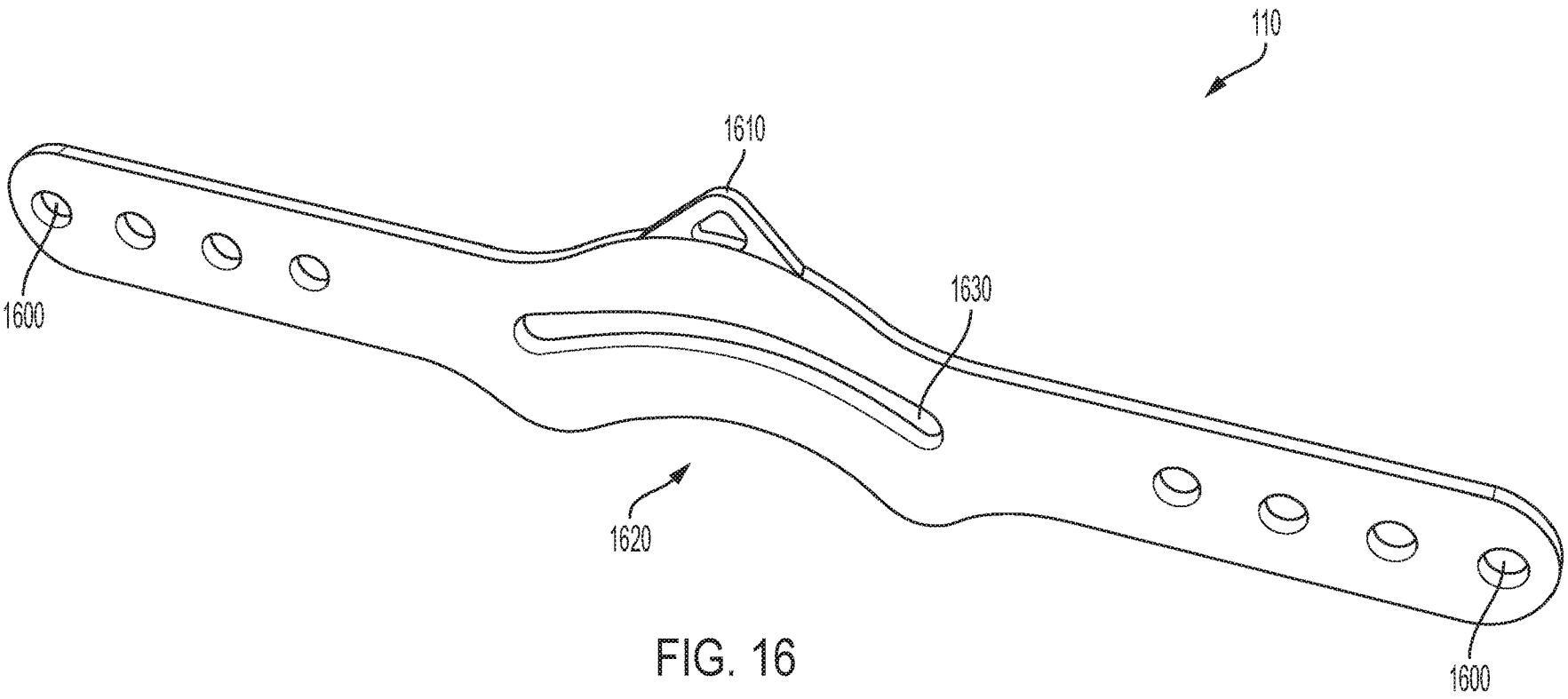
FIG. 16 is a perspective view of a foot strap for a monofin in accordance with an embodiment of the inventive concepts.

FIG. 16 is a perspective view of exemplary foot strap 110 for the monofin or swimming device 100 of FIGS. 1-6. As shown, foot strap 110 includes a plurality of holes 1600 into which tabs 120 are intended to pass in order to attach the foot strap to skeleton 700 and/or the monofin or swimming device 100. Foot strap 110 is made of a suitably flexible material such that one or more of tabs 120 (or a portion thereof) can be slightly larger than hole 1600, such that the tab can pass through the hole with a modicum of force and yet not release from the hole too easily. FIGS. 2-3 show foot strap 110 attached to the monofin or swimming device 100. FIG. 16 also shows foot strap 110 as including handle 1610, which a user can use to assist donning the monofin or otherwise to adjust the foot strap. While FIG. 16 shows handle 1610 positioned in the middle of the foot strap, the invention is not so limited. Nor is the invention limited to a single handle 1610, since a handle could be located on both or one side of the foot strap.

FIG. 16 also shows foot strap 110 as including conforming surface 1620. As shown in this particular embodiment, conforming surface 1620 consists of a slightly concave shape in the middle of the foot strap, which is intended to impart a contour that more closely matches the back side of a user's heal so that the foot strap is more comfortable and fits better. Likewise, foot strap 110 is shown as including gap 1630 in conforming surface 1620, which again is intended to increase user comfort and fit.

As indicated, skeleton 700 and outer shell 1200 are combined to form the monofin or swimming device 100. The process for combining the two is accomplished by overmolding. As those skilled in the art will appreciate, overmolding is a process where a single part is created using two or more different materials in combination. Typically the first material, sometimes referred to as the substrate, is partially or fully covered by subsequent materials (overmold materials) during the manufacturing process.

The resulting combination of skeleton 700 and outer shell 1200 provides a monofin having a unique combination of rigid and less rigid components that collectively provide a user with increased propulsion without requiring undue strength or effort. Likewise, the design of skeleton 700 with its combination of open areas 770/780, ribs 710/720/730, and rigid material 760 can (depending on the placement and orientation of each) enable the monofin to be folded for increased ease of packing and carrying. For example, the monofin having the particular design shown by the exemplary Figures would be able to be folded at least between right edge 170 and the right-most rib 190 (as shown in FIG. 1), as well as folded at least between the left edge 180 and the left-most rib 190 (as shown in FIG. 1). Of course, other embodiments imparted by alternately located open area(s), rib placement(s), and rigid material positioning are possible.

Figure 18:
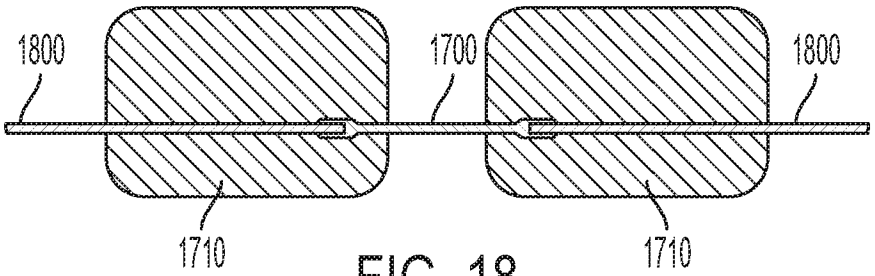
FIG. 18 is a portion of a cross section of FIG. 17.
Figure 19:
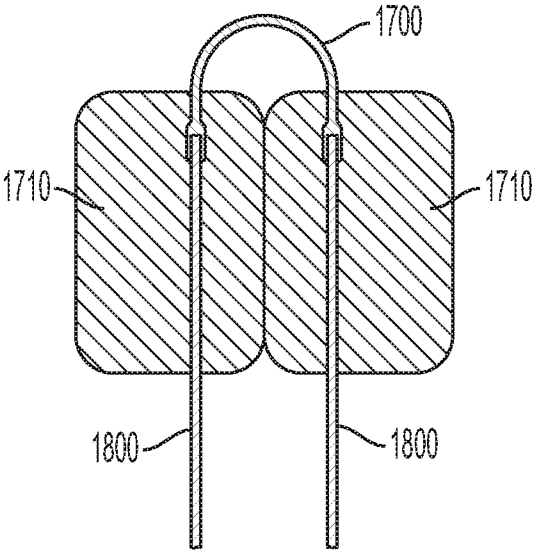
FIG. 19 is an embodiment of the cross section of FIG. 18.
Figure 17:
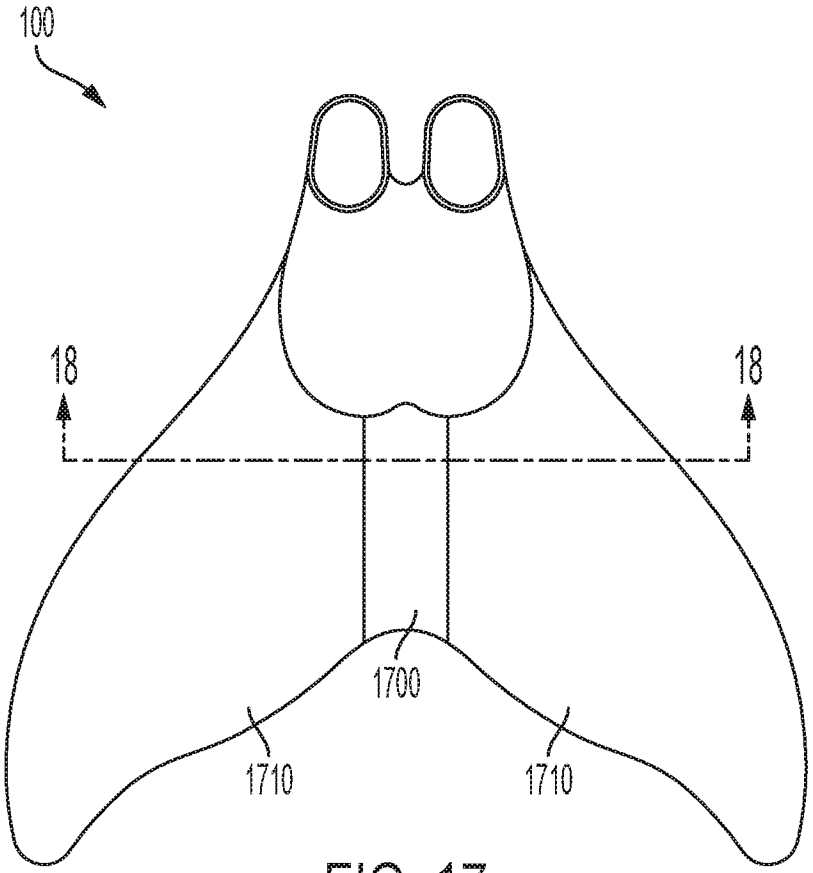
FIG. 17 is a top view of a monofin in accordance with an embodiment of the inventive concepts.

FIG. 17 illustrates another example. Specifically, FIG. 17 shows a top view of a monofin in accordance with an embodiment of the inventive concepts. In this embodiment, the monofin or swimming device 100 includes at least a portion of skeleton layer 1700 sandwiched between layers 1710 on either side of layer 1700. FIG. 18 illustrates an enlarged portion of a cross section of FIG. 17 taken along the cross-section line shown in FIG. 17. As FIG. 18 shows, a layer 1800 of the skeleton is attached to opposite ends of layer 1700. (In this particular embodiment, layer 1800 is not visible in FIG. 17 because it is underneath layer 1710.) In this particular embodiment, layer 1700 is either more flexible than layer 1800 or is made so by the addition of layer 1710 on layer 1800. Indeed, layer 1700 is sufficiently flexible that it can be bent or deformed to substantially the shape of the monofin to the shape shown in FIG. 19. In this manner, the monofin or swimming device 100 can be bent or folded for increased ease of packing and carrying.

Figure 21:
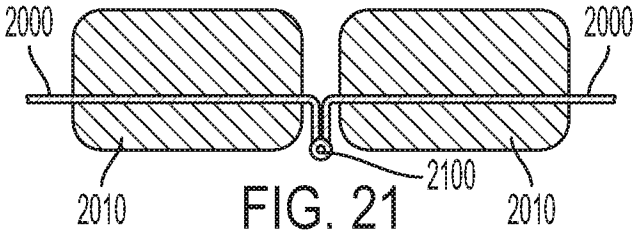
FIG. 21 is a portion of a cross section of FIG. 20.
Figure 22:
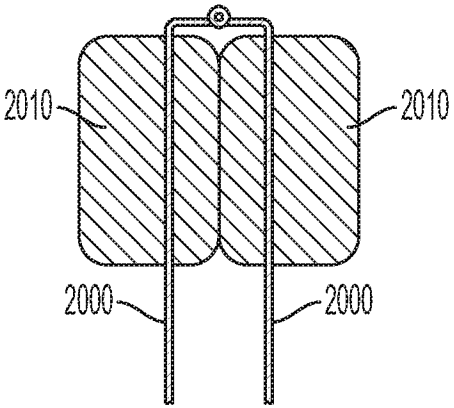
FIG. 22 is an embodiment of the cross section of FIG. 21.
Figure 23:
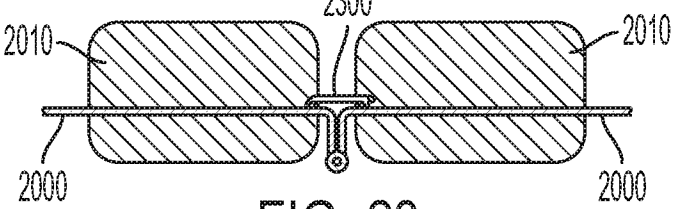
FIG. 23 is an embodiment of the cross section of FIG. 21.
Figure 20:
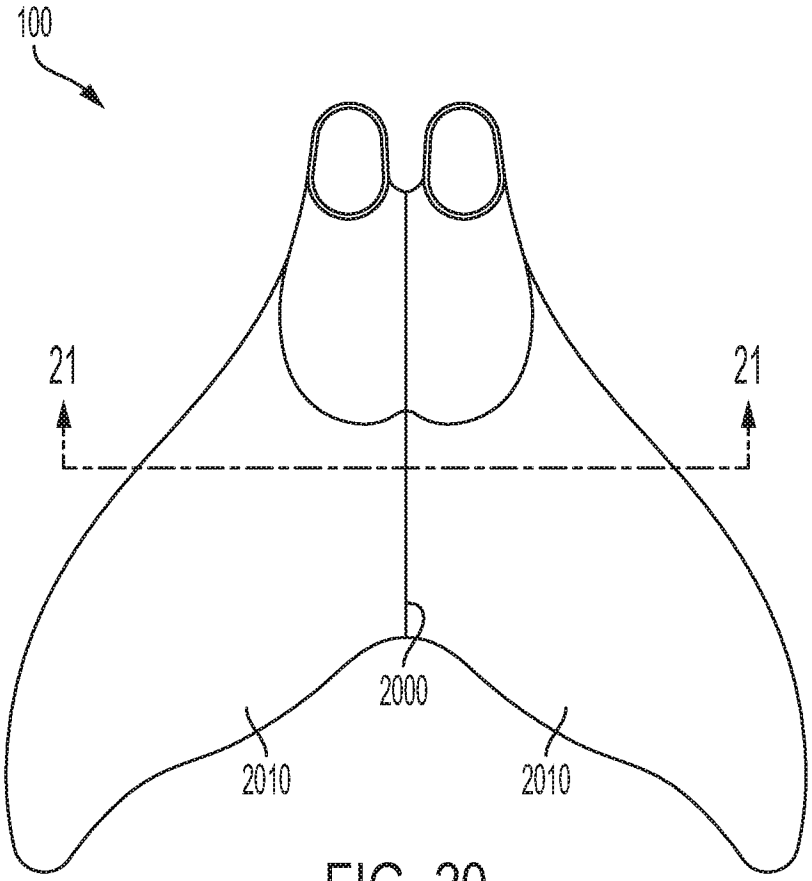
FIG. 20 is a top view of a monofin in accordance with an embodiment of the inventive concepts.

FIG. 20 illustrates another example. Specifically, FIG. 20 shows a top view of a monofin in accordance with an embodiment of the inventive concepts. In this embodiment, the monofin or swimming device 100 includes at least a portion of skeleton layer 2000 sandwiched between layers 2010 on either side of layer 2000. FIG. 21 illustrates an enlarged portion of a cross section of FIG. 20 taken along the cross-section line shown in FIG. 20. As FIG. 21 shows, layer 2000 of the skeleton extends through layer 2010. (In this particular embodiment, layer 2000 is not visible in FIG. 20 because it is underneath layer 2010.) In this particular embodiment, layer 2000 includes a hinge 2100. As shown, hinge 2100 operates to bend or deform the shape of the monofin to the shape shown in FIG. 22. In this manner, the monofin or swimming device 100 can be bent or folded for increased ease of packing and carrying. Finally, as shown in FIG. 23, hinge 2100 can include a clasp 2300 to "lock" the hinge in place, for example while the monofin is in use. Clasp 2300 would be "unlocked" when the user wants to fold the monofin for transport.

While certain exemplary embodiments are shown in the Figures and described in this disclosure, it is to be distinctly understood that the presently disclosed inventive concept(s) is not limited thereto but may be variously embodied within the scope of the following claims. From the foregoing description, it will be apparent that various changes may be made without departing from the spirit and scope of the disclosure as defined by the following claims.

We claim:

1. A monofin comprising:

a skeleton; and an outer shell, where the skeleton provides the monofin with areas of varying rigidity and wherein the skeleton includes ribs, including a right rib, a left rib, and one or more intervening ribs, and wherein the skeleton includes a rigid material between intervening ribs, an open area between an intervening rib and the right rib, and an open area between an intervening rib and the left rib, and wherein the skeleton includes a right foot bottom and a left foot bottom, wherein the outer shell includes a left edge, a right edge, and one or more rib coverings.

2. The monofin of claim 1 wherein the outer shell includes material between the left edge and a rib covering, material between the right edge and a rib covering, and a region of no material between a first rib covering and a second rib covering.

3. The monofin of claim 2 wherein the outer shell includes a right foot cover and a left foot cover.

4. The monofin of claim 3 wherein the left rib and the right rib are more flexible than one or more of the intervening ribs.

5. The monofin of claim 4 wherein the outer shell overlays the skeleton such that the material between the left edge and a rib covering overlays the open area between an intervening rib and the left rib, and the material between the right edge and a rib covering overlays the open area between an intervening rib and the right rib.

6. The monofin of claim 5 wherein the outer shell overlays the skeleton such that the region of no material between a first rib covering and a second rib covering overlays the rigid material between intervening ribs.

7. The monofin of claim 6 wherein the outer shell overlays the skeleton such that the right foot cover overlays the right foot bottom and the left foot cover overlays the left foot bottom.

8. The monofin of claim 7 wherein the outer shell and the skeleton are overmolded.

9. The monofin of claim 8 wherein an intervening rib is flexible such that the swimming device can bend along that intervening rib so the device can be more easily transported.

10. The monofin of claim 8 wherein an intervening rib includes a hinge such that the swimming device can bend along that intervening rib so the device can be more easily transported.

* * * * *